US010634415B2

(12) United States Patent
Vijayan et al.

(10) Patent No.: US 10,634,415 B2
(45) Date of Patent: Apr. 28, 2020

(54) REFRIGERATOR APPLIANCE AND ARC-RESISTANT HEATING ASSEMBLY

(71) Applicant: Haier US Appliance Solutions, Inc., Wilmington, DE (US)

(72) Inventors: Vineeth Vijayan, Louisville, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 114 days.

(21) Appl. No.: 15/967,631

(22) Filed: May 1, 2018

(65) Prior Publication Data

US 2019/0338997 A1 Nov. 7, 2019

(51) Int. Cl.
*F25D 21/08* (2006.01)
*F25B 1/00* (2006.01)

(52) U.S. Cl.
CPC ..... *F25D 21/08* (2013.01); *F25B 1/00* (2013.01); *F25B 2400/12* (2013.01)

(58) Field of Classification Search
CPC ... H05B 3/00; H05B 3/14; H05B 3/42; H05B 3/44; H05B 3/48; H05B 3/54; H05B 3/56; H05H 3/40; F25D 21/08; F25D 11/02; F25D 29/00; F25B 2400/12; F25B 1/00
See application file for complete search history.

(56) References Cited

U.S. PATENT DOCUMENTS

| | | | | |
|---|---|---|---|---|
| 2,816,200 A | | 12/1957 | Mudge | |
| 3,581,144 A | | 5/1971 | Beggs | |
| 3,648,218 A | * | 3/1972 | Kellerman | H01C 1/142 338/160 |
| 3,694,626 A | | 9/1972 | Harnden, Jr. | |
| 4,370,692 A | | 1/1983 | Wellman, Jr. et al. | |
| 5,552,581 A | * | 9/1996 | Jasper, II | F25D 21/08 219/523 |
| 2008/0175572 A1 | * | 7/2008 | Barnes | H05B 3/48 392/497 |

FOREIGN PATENT DOCUMENTS

JP 2001-002078 A * 10/2000

* cited by examiner

*Primary Examiner* — Emmanuel E Duke
(74) *Attorney, Agent, or Firm* — Dority & Manning, P.A.

(57) ABSTRACT

A refrigerator appliance and an arc-resistant heating assembly are provided herein. The refrigerator appliance may include a cabinet defining a chilled chamber, a sealed system, and an electrical heater. The electrical heater may include a resistive element, a sheath, a thermally conductive electrical insulation, and an internal insulator. The sheath may be disposed about the resistive element from a first end portion to a second end portion. The thermally conductive electrical insulation may be radially positioned between the resistive element and the sheath. The internal insulator may be radially positioned between the resistive element and the thermally conductive electrical insulation.

20 Claims, 12 Drawing Sheets

REFRIGERATOR APPLIANCE AND ARC-RESISTANT HEATING ASSEMBLY

FIELD OF THE INVENTION

The present subject matter relates generally to electrical heating assemblies, and more particularly to heating assemblies for refrigerator appliances.

BACKGROUND OF THE INVENTION

Refrigerators or refrigerator appliances generally include a cabinet that defines a chilled chamber. The chilled chamber is commonly cooled with a sealed system having an evaporator. One problem that may be encountered with existing refrigerator appliances is inefficient defrosting of the evaporator. For example, when the evaporator is active, frost can accumulate on the evaporator and thereby reduce efficiency of the evaporator. One effort to reduce or eliminate frost from the evaporator has been to utilize a heater, such as an electrical heater, to heat the evaporator when the evaporator is not operating.

Utilizing an electrical heater to defrost an evaporator can pose certain challenges. For example, certain refrigerators utilize a flammable refrigerant within the sealed system. In such systems, a surface temperature of the heater is generally limited to a temperature well below the auto-ignition temperature of the flammable refrigerant. However, the evaporator generally requires a certain power output from the heater to suitably defrost. Moreover, it is possible that a portion of electrical heater may fail (e.g., following unforeseen damage to the electrical heater). In some instances, a portion of the electrical heater may short-circuit and spark. For example, a heating element may rupture or zipper, resulting in a potential electrical arc from the heating element.

Accordingly, a heating assembly with certain safety features would be useful. In particular, a heating assembly that is configured to prevent zippering in a refrigerator appliance. Moreover, it may also be useful to have a refrigerator appliance with a heating assembly for defrosting an evaporator of the refrigerator appliance while also operating well below an auto-ignition temperature of a flammable refrigerant within the evaporator would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a chilled chamber, a sealed system, and an electrical heater. The sealed system may include an evaporator. The evaporator may be disposed at the chilled chamber. The electrical heater may be positioned adjacent the evaporator. The electrical heater may include a resistive element, a sheath, a thermally conductive electrical insulation, and an internal insulator. The sheath may be disposed about the resistive element from a first end portion to a second end portion. The thermally conductive electrical insulation may be radially positioned between the resistive element and the sheath. The internal insulator may be radially positioned between the resistive element and the thermally conductive electrical insulation.

In another exemplary aspect of the present disclosure, and electrical heating assembly for a consumer appliance is provided. The electrical heating assembly may include a sheath, a resistive element, a thermally conductive electrical insulation, and an internal insulator. The sheath may define an enclosed volume along a length between a first end portion and a second end portion. The resistive element may be disposed within the enclosed volume to generate heat in response to an electrical current. The thermally conductive electrical insulation may be radially positioned between the resistive element and the sheath. The internal insulator may be radially positioned between the resistive element and the thermally conductive electrical insulation.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
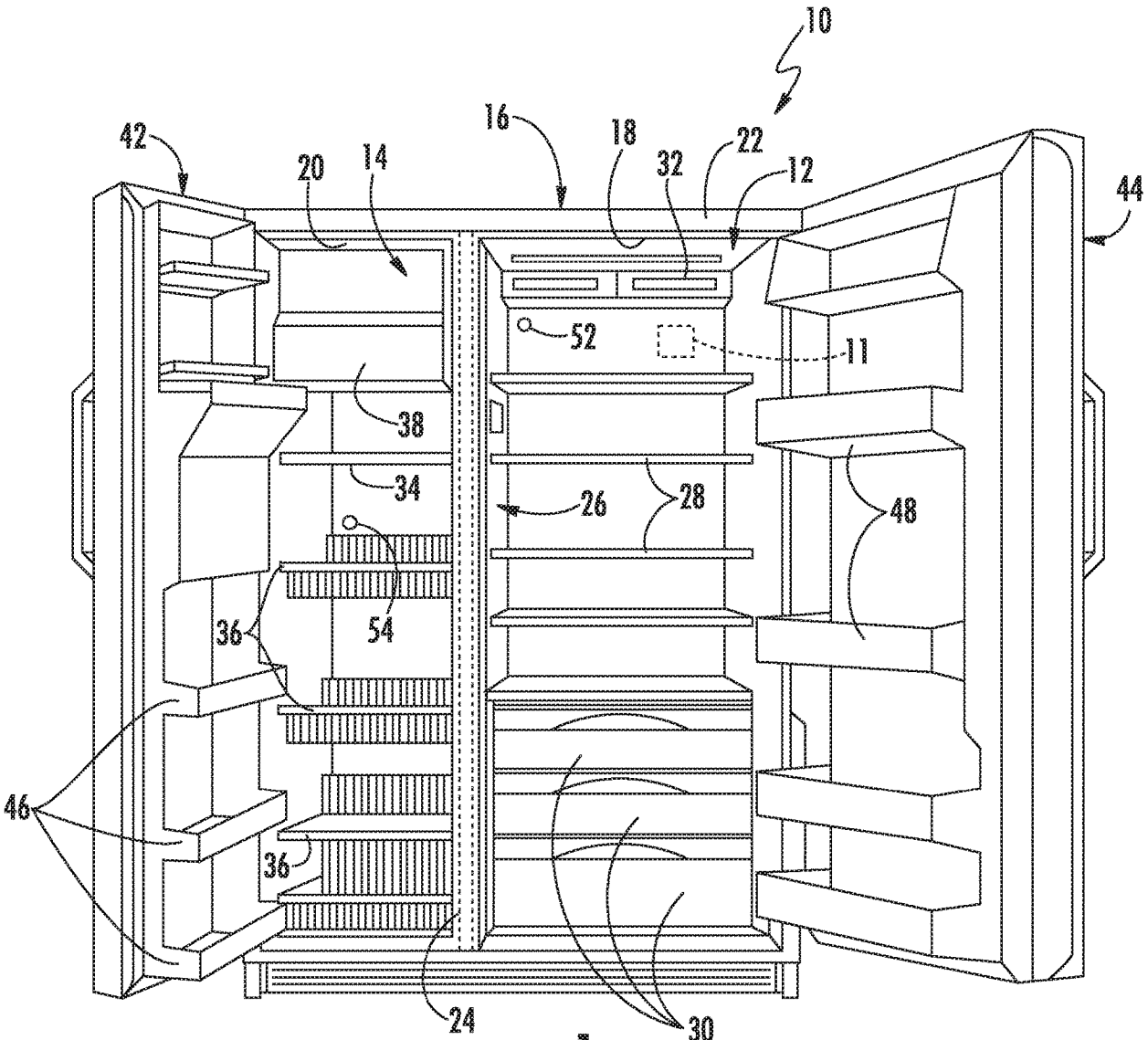
FIG. 1 provides a front perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The phrase "in one embodiment," does not necessarily refer to the same embodiment, although it may.

FIG. 1 provides a front view of a representative refrigerator appliance 10 according to exemplary embodiments of the present disclosure. More specifically, for illustrative purposes, the present disclosure is described with a refrigerator appliance 10 having a construction as shown and described further below. As used herein, a refrigerator appliance includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that the configuration shown in FIG. 1 is by way of example only.

Refrigerator appliance 10 includes a fresh food storage compartment 12 and a freezer storage compartment 14. Freezer compartment 14 and fresh food compartment 12 are arranged side-by-side within an outer case 16 and defined by inner liners 18 and 20 therein. A space between case 16 and liners 18, 20 and between liners 18, 20 may be filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

Refrigerator appliance 10 can be operated by one or more controllers 11 or other processing devices according to programming or user preference via manipulation of a control interface 32 mounted, e.g., in an upper region of fresh food storage compartment 12 and connected with controller 11. Controller 11 may include one or more memory devices and one or more microprocessors, such as a general or special purpose microprocessor operable to execute programming instructions or micro-control code associated with the operation of the refrigerator appliance 10. The memory may represent random access memory such as DRAM, or read only memory such as ROM or FLASH. In one embodiment, the processor executes programming instructions stored in memory. The memory may be a separate component from the processor or may be included onboard within the processor. Controller 11 may include one or more proportional-integral ("PI") controllers programmed, equipped, or configured to operate the refrigerator appliance according to example aspects of the control methods set forth herein. Accordingly, as used herein, "controller" includes the singular and plural forms.

Controller 11 may be positioned in a variety of locations throughout refrigerator appliance 10. In the illustrated embodiment, controller 11 may be located e.g., behind an interface panel 32 or doors 42 or 44. Input/output ("I/O") signals may be routed between the control system and various operational components of refrigerator appliance 10 along wiring harnesses that may be routed through e.g., the back, sides, or mullion 26. Typically, through user interface panel 32, a user may select various operational features and modes and monitor the operation of refrigerator appliance 10. In one embodiment, the user interface panel 32 may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. User interface panel 32 may be in communication with controller 11 via one or more signal lines or shared communication busses.

In some embodiments, one or more temperature sensors are provided to measure the temperature in the fresh food compartment 12 and the temperature in the freezer compartment 14. For example, first temperature sensor 52 may be disposed in the fresh food compartment 12 and may measure the temperature in the fresh food compartment 12. Second temperature sensor 54 may be disposed in the freezer compartment 14 and may measure the temperature in the freezer compartment 14. This temperature information can be provided, e.g., to controller 11 for use in operating refrigerator 10 as will be more fully discussed below. These temperature measurements may be taken intermittently or continuously during operation of the appliance or execution of a control system as further described below.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. In alternative embodiments, one or both doors 42, 44 may be slidable or otherwise movable between open and closed positions. Freezer door 42 includes a plurality of storage shelves 46, and fresh food door 44 includes a plurality of storage shelves 48.

Figure 2:
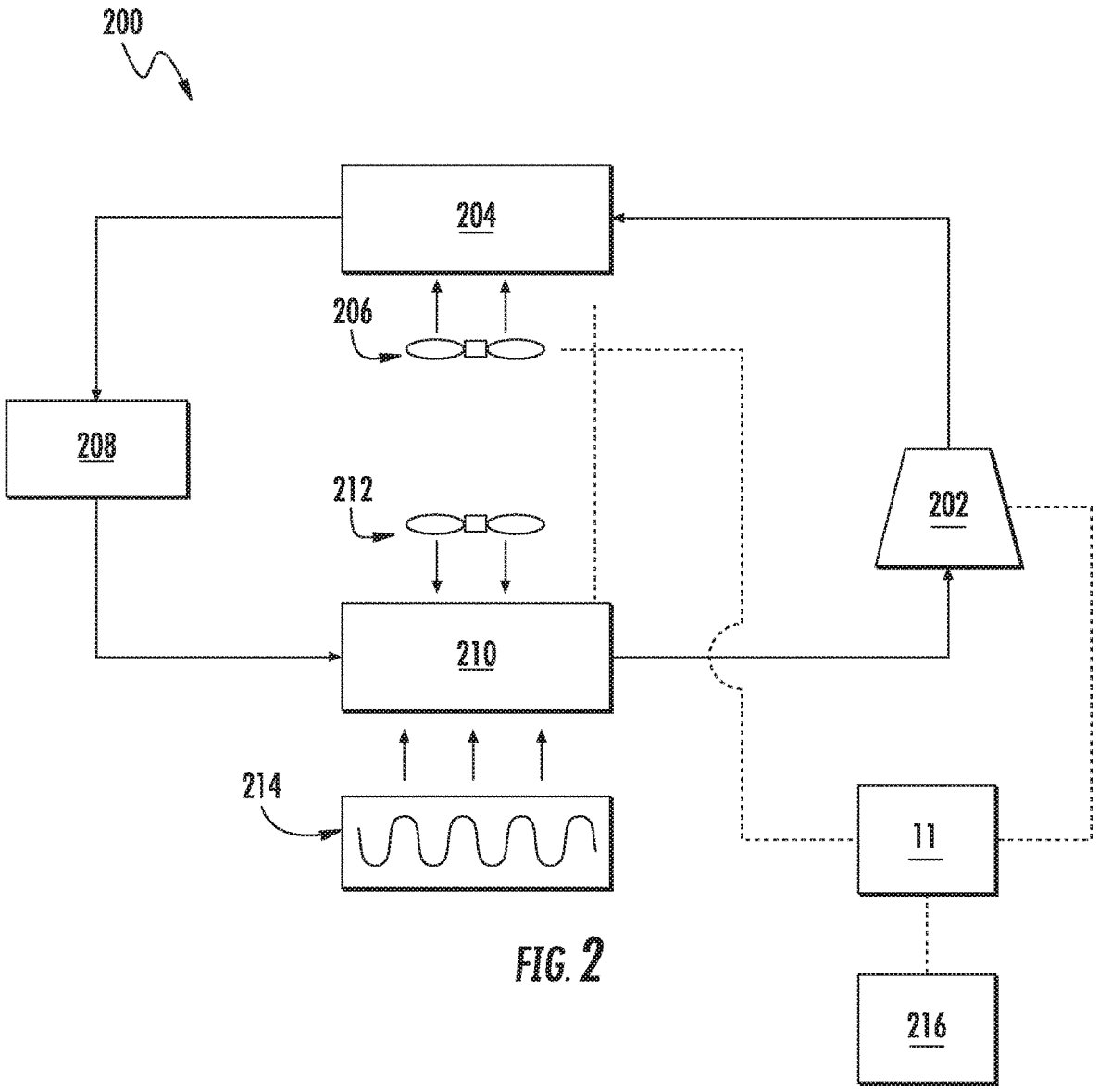
FIG. 2 provides a schematic view of various components of the exemplary embodiments of FIG. 1.

Referring now to FIG. 2, refrigerator appliance 10 may include a refrigeration system 200. In general, refrigeration system 200 is charged with a refrigerant that is flowed through various components and facilitates cooling of the fresh food compartment 12 and the freezer compartment 14.

Refrigeration system 200 may be charged or filled with any suitable refrigerant. For example, refrigeration system 200 may be charged with a flammable refrigerant, such as R441A, R600a, isobutene, isobutane, etc.

Refrigeration system 200 includes a compressor 202 for compressing the refrigerant, thus raising the temperature and pressure of the refrigerant. Compressor 202 may for example be a variable speed compressor, such that the speed of the compressor 202 can be varied between zero (0) and one hundred (100) percent by controller 11. Refrigeration system 200 may further include a condenser 204, which may be disposed downstream of compressor 202, e.g., in the direction of flow of the refrigerant. Thus, condenser 204 may receive refrigerant from the compressor 202, and may condense the refrigerant by lowering the temperature of the refrigerant flowing therethrough due to, e.g., heat exchange with ambient air. A condenser fan 206 may be used to force air over condenser 204 as illustrated to facilitate heat exchange between the refrigerant and the surrounding air. Condenser fan 206 can be a variable speed fan—meaning the speed of condenser fan 206 may be controlled or set anywhere between and including, e.g., zero (0) and one hundred (100) percent. The speed of condenser fan 206 can be determined by, and communicated to, fan 206 by controller 11.

Refrigeration system 200 further includes an evaporator 210 disposed downstream of the condenser 204. Additionally, an expansion device 208 may be utilized to expand the refrigerant, thus further reduce the pressure of the refrigerant, leaving condenser 204 before being flowed to evaporator 210. Evaporator 210 generally is a heat exchanger that transfers heat from air passing over the evaporator 210 to refrigerant flowing through evaporator 210, thereby cooling the air and causing the refrigerant to vaporize. An evaporator fan 212 may be used to force air over evaporator 210 as illustrated. As such, cooled air is produced and supplied to refrigerated compartments 12, 14 of refrigerator appliance 10. In certain embodiments, evaporator fan 212 can be a variable speed evaporator fan—meaning the speed of fan 212 may be controlled or set anywhere between and including, e.g., zero (0) and one hundred (100) percent. The speed of evaporator fan 212 can be determined by, and communicated to, evaporator fan 212 by controller 11.

Evaporator 210 may be in communication with fresh food compartment 12 and freezer compartment 14 to provide cooled air to compartments 12, 14. Alternatively, refrigeration system 200 may include more two or more evaporators, such that at least one evaporator provides cooled air to fresh food compartment 12 and at least one evaporator provides cooled air to freezer compartment 14. In other embodiments, evaporator 210 may be in communication with any suitable component of the refrigerator appliance 10. For example, in some embodiments, evaporator 210 may be in communication with ice maker 38, such as with an ice compartment of the ice maker 38. From evaporator 210, refrigerant may flow back to and through compressor 202, which may be downstream of evaporator 210, thus completing a closed refrigeration loop or cycle.

As shown in FIG. 2, a defrost heater 214 may be utilized to defrost evaporator 210, i.e., to melt ice that accumulates on evaporator 210. Heater 214 may be positioned adjacent or in close proximity (e.g., below) evaporator 210 within fresh food compartment 12 or freezer compartment 14. Heater 214 may be activated periodically; that is, a period of time $t_{ice}$ elapses between when heater 214 is deactivated and when heater 214 is reactivated to melt a new accumulation of ice on evaporator 210. The period of time $t_{ice}$ may be a preprogrammed period such that time $t_{ice}$ is the same between each period of activation of heater 214, or the period of time may vary. Alternatively, heater 214 may be activated based on some other condition, such as the temperature of evaporator 210 or any other appropriate condition.

Additionally, a defrost termination thermostat 216 may be used to monitor the temperature of evaporator 210 such that defrost heater 214 is deactivated when thermostat 216 measures that the temperature of evaporator 210 is above freezing, i.e., greater than zero degrees Celsius (0° C.). In some embodiments, thermostat 216 may send a signal to controller 11 or other suitable device to deactivate heater 214 when evaporator 210 is above freezing. In other embodiments, defrost termination thermostat 216 may comprise a switch such that heater 214 is switched off when thermostat 216 measures that the temperature of evaporator 210 is above freezing.

Figure 3:
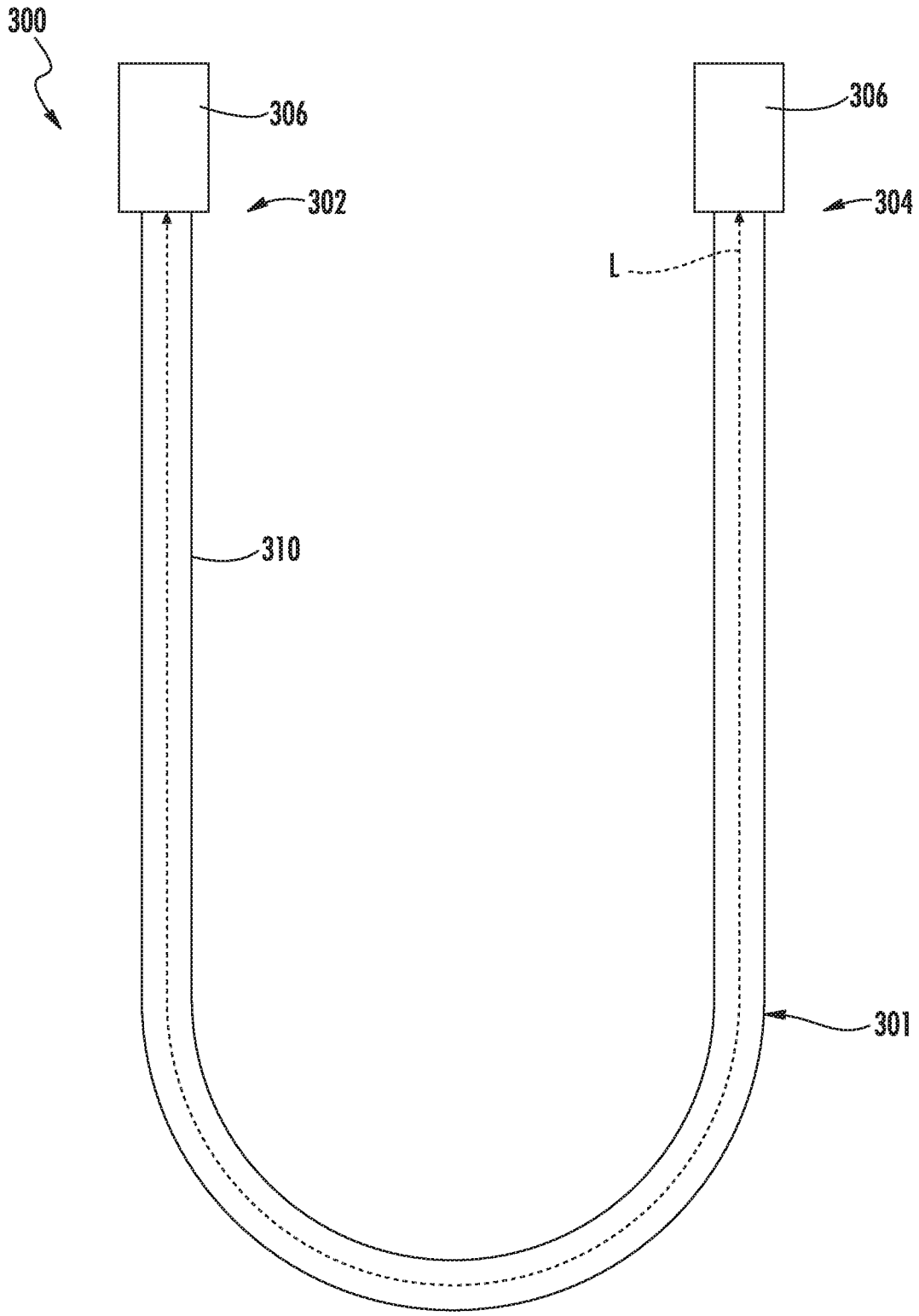
FIG. 3 provides a schematic view of a heating assembly for use in a refrigerator appliance according to exemplary embodiments of the present disclosure.
Figure 4:
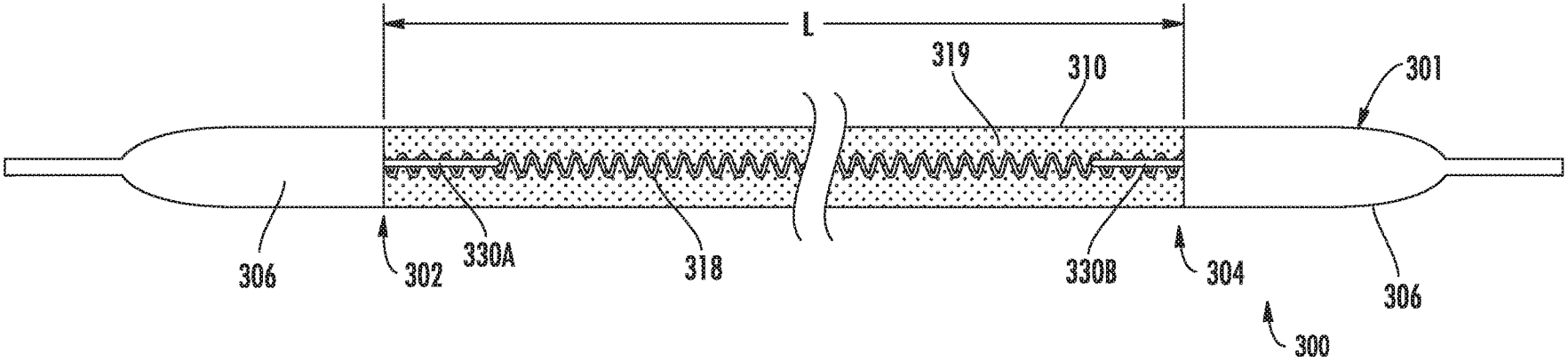
FIG. 4 provides a side view of a portion of a heating assembly of according to exemplary embodiments of the present disclosure.

FIG. 3 provides a schematic view of a heating assembly 300 according to exemplary embodiments of the present disclosure. FIG. 4 provides a side view (e.g., partial or interrupted side view) of a heating assembly 300 according to additional or alternative embodiments. Heating assembly 300 generally includes an electrical heater 301 and may be used in or with any suitable refrigerator appliance as a defrost heater. For example, heating assembly 300, including electrical heater 301, may be used as defrost heater 214 in refrigeration system 200 to defrost evaporator 210 (FIG. 2). Thus, heating assembly 300 is discussed in greater detail below in the context of refrigerator appliance 10 (FIG. 1). As discussed in greater detail below, heating assembly 300 includes features for defrosting evaporator 210 while operating such that a surface temperature of heating assembly 300 (e.g., the temperature at an exterior surface of sheath 310) is well below a maximum temperature, e.g., an auto-ignition temperature of a flammable refrigerant within evaporator 210. As used herein, the term "well below" means no less than seventy-five degrees Celsius (75° C.) when used in the context of temperatures. Thus, e.g., the surface temperature of heating assembly 300 may be no less than one-hundred degrees Celsius (100° C.) below the auto-ignition temperature of the flammable refrigerant within evaporator 210 during operation of heating assembly 300 in certain exemplary embodiments.

As shown in FIG. 3, heating assembly 300 includes an electrical heater 301 having a sheath 310 formed into any suitable shape. For example, as shown in FIG. 3, sheath 310 may be U-shaped in certain exemplary embodiments. In alternative exemplary embodiments, sheath 310 may be straight, circular, arcuate, have multiple coils, etc. Sheath 310 may be a generally solid or non-permeable metal structure that does not permit the passage of liquids, such as water. Sheath 310 may be constructed of or with a suitable thermally conductive metal material. For example, sheath 310 may be constructed of or with aluminum or aluminum alloy material.

As shown in FIG. 3, electrical heater 301 extends between a first end portion 302 and a second end portion 304. Thus, e.g., first end portion 302 and second end portion 304 of electrical heater 301 may each be disposed at or adjacent a respective terminal end of sheath 310. Each of first end portion 302 and second end portion 304 are sealed to prevent the entry of water or moisture within sheath 310. For example, electrical connections or terminals 306 may be positioned at one or both of first end portion 302 and second end portion 304 of electrical heater 301. Optionally, electrical heater 301 may be coupled to an electrical power supply (not shown) at terminals 306.

Electrical heater 301 defines an overall length (shown with dashed line L in FIG. 3) following the path defined by sheath 310 between the first and second end portions 302, 304 of electrical heater 301. The length L of electrical heater 301 may be any suitable length. For example, the length L of electrical heater 301 may be equal to or less than two (2) feet between each terminal 306.

Figure 5:
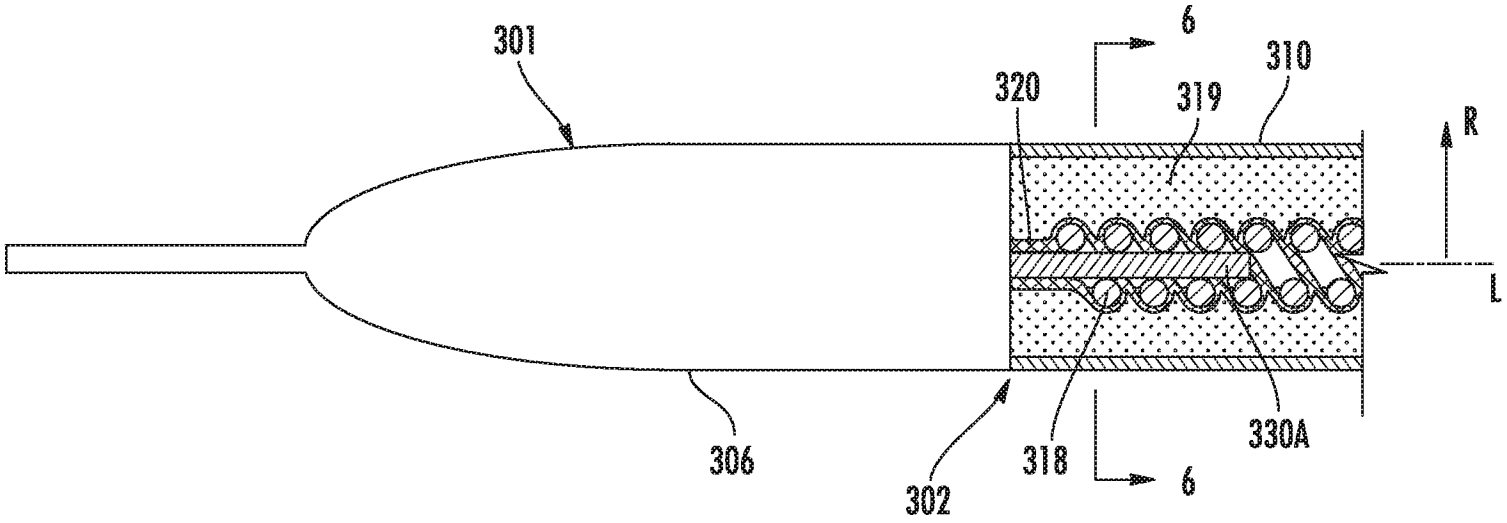
FIG. 5 provides a magnified side view of a portion of the exemplary heating assembly of FIG. 4.
Figure 6:
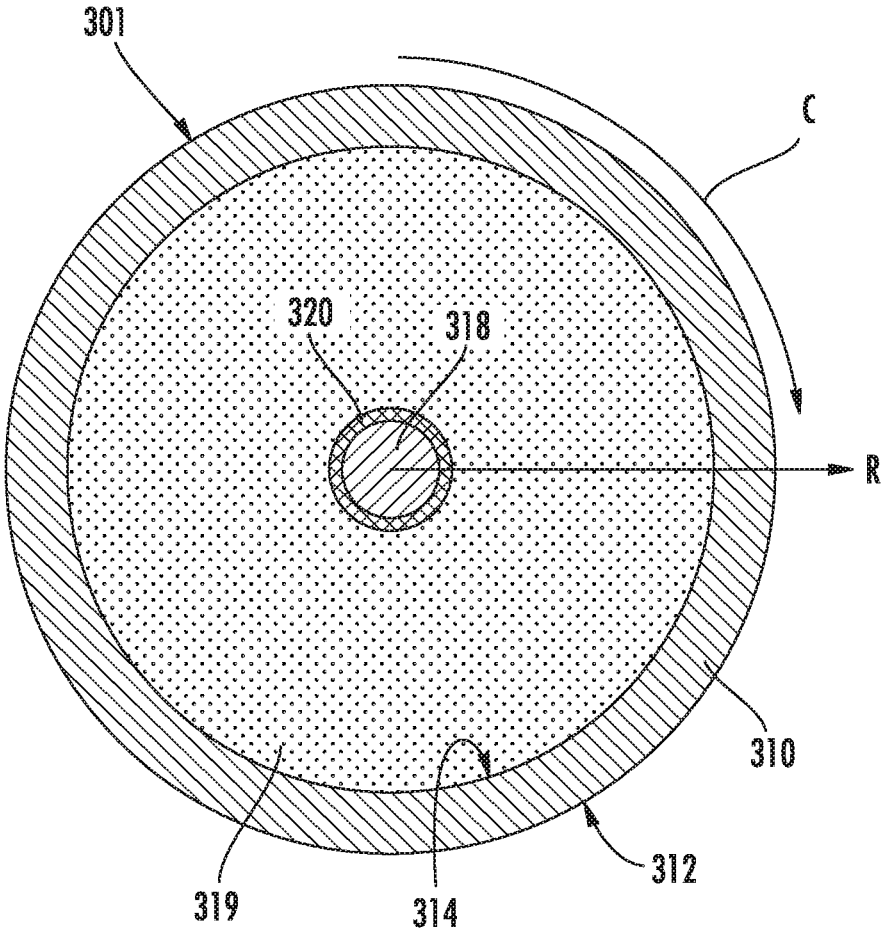
FIG. 6 provides a cross sectional view of the exemplary heating assembly of FIG. 5, taken along the lines 6-6.

Turning now to FIGS. 4 through 6, FIG. 5 provides a magnified view of a portion (e.g., at first end portion 302) of certain embodiments of electrical heater 301. FIG. 6 provides a cross sectional view of electrical heater 301, taken along the lines 6-6. As shown, sheath 310 has an oppositely-disposed pair of surfaces 312, 314, extending along a circumferential direction C. Specifically, sheath 310 has an exterior surface 312 and interior surface 314. Within sheath 310, an enclosed volume 316 may be defined by interior surface 314. In turn, exterior surface 312 is directed (i.e., faces) radially outward, away from enclosed volume 316, while interior surface 314 is directed radially inward, towards enclosed volume 316. Generally, enclosed volume 316 may be defined along the length L from first end portion 302 to second end portion 304.

In some embodiments, various components of heating assembly 300 are disposed within enclosed volume 316 of sheath 310. In particular, heating assembly 300 includes a resistive element or wire 318 that is disposed within enclosed volume 316 of sheath 310. In other words, sheath 310 is disposed about resistive element 318, e.g., along a circumferential direction C defined about resistive element 318 or length L. Resistive element 318 is generally configured to generate heat in response to an electrical current directed to electrical heater 301, e.g., at terminals 306. Resistive element 318 may be any suitable resistive heating element, such as a nickel chromium alloy wire.

Resistive element 318 may be coupled to terminals 306 at opposite ends of resistive element 318. In some such embodiments, a discrete cold pin 330A or 330B may be provided at first and second end portions 302, 304 of electrical heater 301. In particular, a first end cold pin 330A is in electrical communication (e.g., direct or indirect conductive communication) with resistive element 318 at first end portion 302, and a second end cold pin 330B is in electrical communication (e.g., direct or indirect conductive communication) with resistive element 318 at second end portion 304. Both cold pins 330A, 330B may be positioned radially inward from sheath 310 (e.g., at least partially within enclosed volume 316). For instance, each cold pin 330A, 330B may extend from a corresponding terminal 306 into enclosed volume 316 to contact resistive element 318. When assembled, each cold pin 330A, 330B may be joined (e.g., bonded or welded) to resistive element 318. Additionally or alternatively, each cold pin 330A, 330B may be formed from a conductive metal have a lower electrical resistance than the resistive element 318. During use (e.g., active heating operations), a voltage applied across terminals 306 may pass between the cold pins 330A, 330B and resistive element 318, inducing a current within resistive element 318 that in turn causes resistive element 318 to increase in temperature.

Sheath 310 may be packed with a thermally conductive electrical insulation 319, such as magnesium dioxide or vitrified magnesite. In particular, thermally conductive electrical insulation 319 may be radially positioned between the resistive element 318 and the sheath 310. As shown, thermally conductive electrical insulation 319 may generally separate resistive element 318 and sheath 310 along a radial direction R defined from resistive element 318. Moreover, thermally conductive electrical insulation 319 may prevent electrical conduction between resistive element 318 and sheath 310, while permitting heat conduction therethrough.

In some embodiments, an internal insulator 320 is further provided. In particular, internal insulator 320 is radially positioned between the resistive element 318 and the thermally conductive electrical insulation 319. In exemplary embodiments, such as those illustrated in FIGS. 4 through 6, internal insulator 320 is formed as, or includes, a dielectric insulation coating applied to at least a portion of resistive element 318. For instance, a suitable dielectric material (e.g., silicon-ceramic coatings; oxides of aluminum, titanium, or yttrium; etc.) may be formed or applied directly on an outer radial surface of resistive element 318 or cold pins 330A, 330B. Heat transfer between resistive element 318 and sheath 310 via internal insulator 320 and thermally conductive electrical insulation 319 may heat sheath 310 during operation of heating assembly 300. Thus, sheath 310, resistive element 318, internal insulator 320, and thermally conductive electrical insulation 319 may collectively form a Calrod® heating resistance element.

In certain embodiments, the dielectric insulation coating of internal insulator 320 extends across resistive element 318 from first end portion 302 to second end portion 304. In turn, internal insulator 320 surrounds resistive element 318 across its full length. As illustrated, both cold pins 330A, 330B may be similarly surrounded by internal insulator 320. In some such embodiments, internal insulator 320 extends continuously or uninterrupted across an outer radial surface of each cold pin 330A, 320B to an outer surface of resistive element 318. Advantageously, internal insulator 320 may protect resistive element 318 and prevent arcing (e.g., during instances in which an unforeseen breakdown occurs within the thermally conductive electrical insulation 319).

Figure 7:
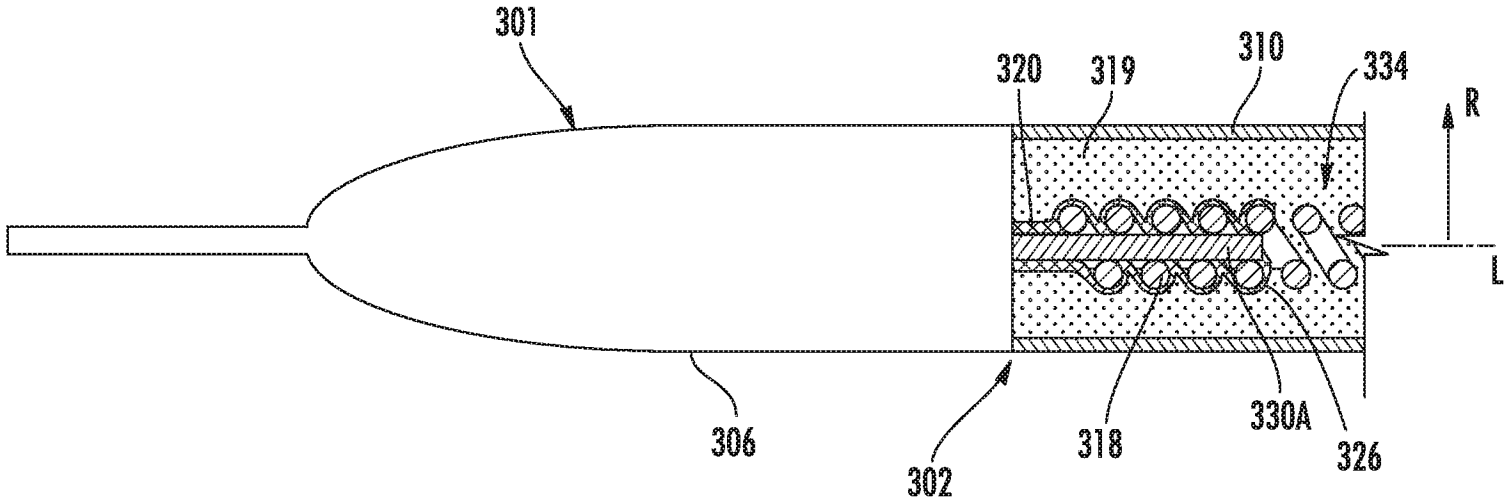
FIG. 7 provides a magnified side view of a portion of a heating assembly according to other exemplary embodiments.

Although FIGS. 4 through 6 illustrate the dielectric insulation coating of internal insulator 320 extending across resistive element 318 from first end portion 302 to second end portion 304, it is understood that alternative embodiments may provide internal insulator 320 across only a portion of resistive element 318. For instance, other exemplary embodiments, such as those illustrated in FIG. 7, may include discrete coating segments (e.g., first and second segments 326) at the first end portion 302 and second end portion 304, respectively. Each coating segment 326 may extend from a corresponding terminal 306 continuously or uninterrupted over each cold pin 330A, 320B and an adjacent portion of resistive element 318. An uncoated section 334 of resistive element 318 may extend between the coating segments 326. Thus, the coating segments 326 may be spaced apart from each other along a portion of the length L between the first end portion 302 and the second end portion 304. Advantageously, internal insulator 320 may protect and prevent arcing at cold pins 330A, 330B and adjacent portions of resistive element 318 (e.g., during instances in which an unforeseen breakdown occurs within the thermally conductive electrical insulation 319).

Figure 8:
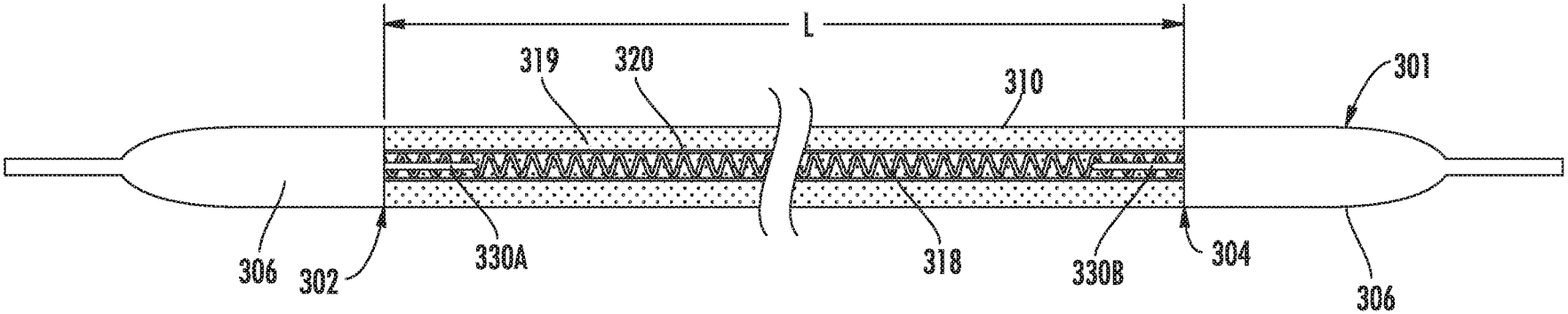
FIG. 8 provides a side view of a portion of a heating assembly of according to further exemplary embodiments of the present disclosure.
Figure 9:
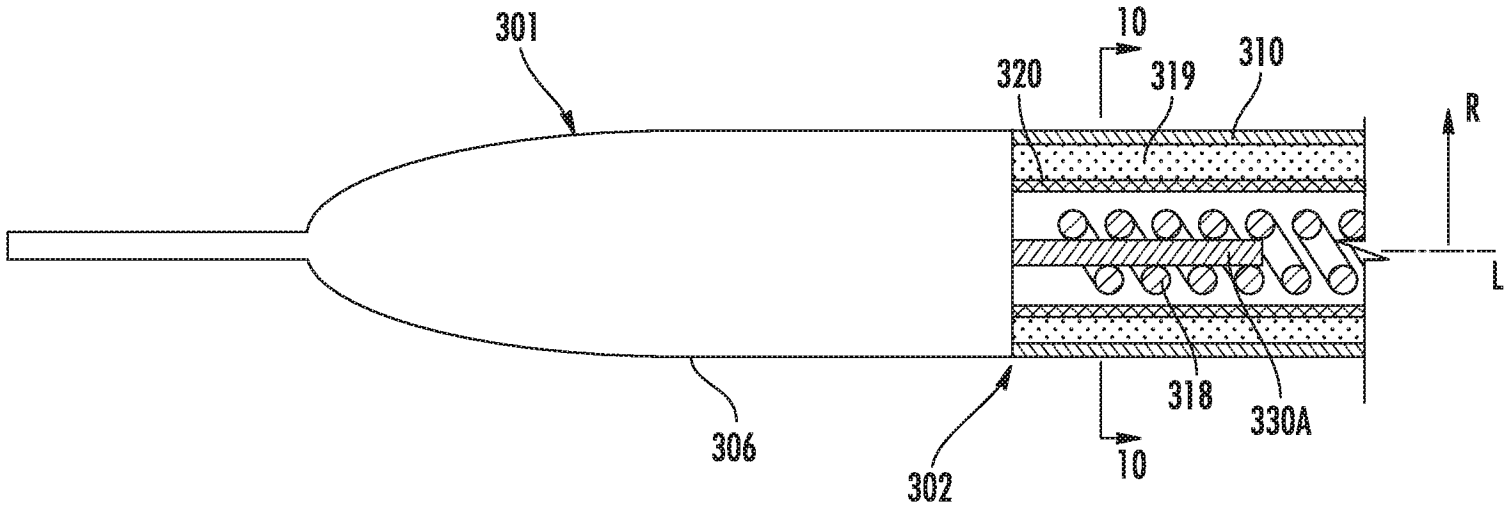
FIG. 9 provides a magnified side view of a portion of the exemplary heating assembly of FIG. 8.
Figure 10:
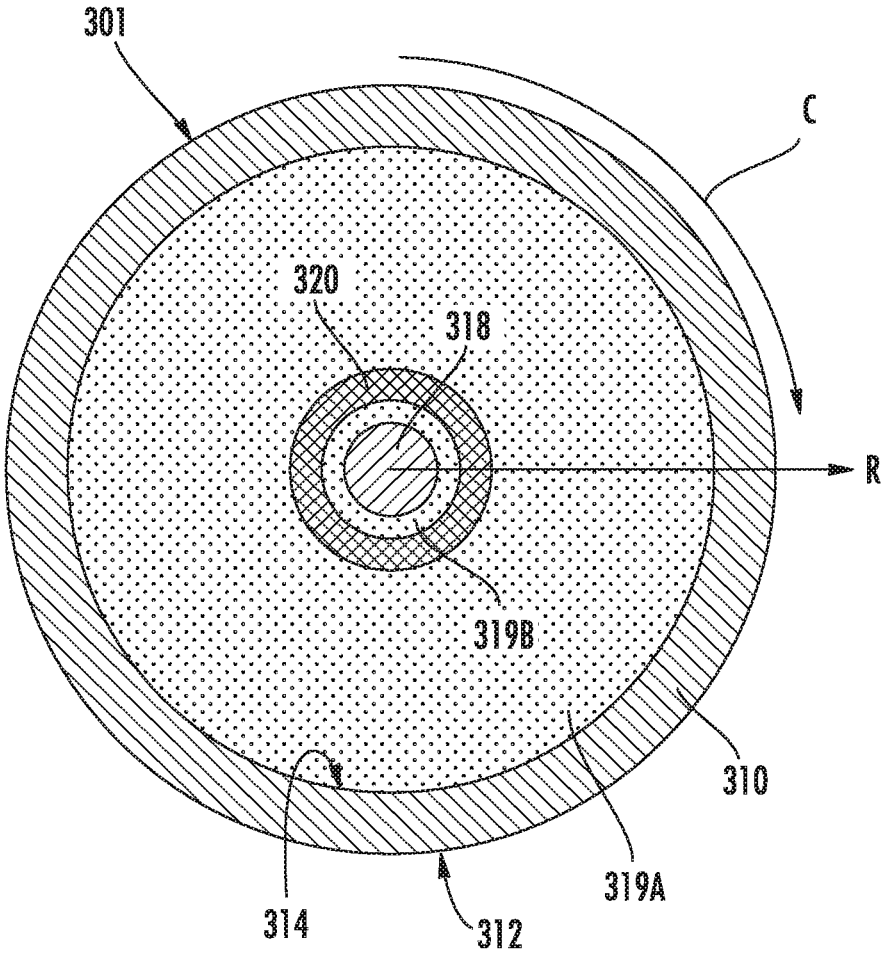
FIG. 10 provides a cross sectional view of the exemplary heating assembly of FIG. 9, taken along the lines 10-10.

Turning now to FIGS. 8 through 10, various views of portions of further exemplary embodiments of electrical heater 301 are provided. In particular, FIG. 8 provides a side view (e.g., partial or interrupted side view) of a heating assembly 300 according to further exemplary embodiments. FIG. 9 provides a magnified view of a portion (e.g., at first end portion 302) of electrical heater 301. FIG. 10 provides a cross sectional view of electrical heater 301, taken along the lines 10-10. Except as otherwise indicated, it is understood that the exemplary embodiments of FIGS. 8 through 10 include one or more of the features of the above-described embodiments illustrated in FIGS. 1 through 7.

As an example, in some embodiments, internal insulator 320 is formed as or includes a dielectric sheath extending within enclosed volume 316. For instance, the dielectric sheath of internal insulator 320 may include a rigid tube formed from, or including, a suitable dielectric ceramic (e.g., oxides of aluminum, titanium, yttrium, etc.). In certain embodiments, the dielectric sheath of internal insulator 320 may be radially spaced from the resistive element 318 or cold pins 330A, 330B. In other words, a predetermined radial space is defined along the radial direction R between an inner radial surface of internal insulator 320 and an outer radial surface of resistive element 318 or cold pins 330A, 330B. The radial space may be constant along the length L (FIG. 3) of electrical heater 301. In some such embodiments, the radial space may be filled with a secondary portion of thermally conductive electrical insulation 319B, while a primary portion of thermally conductive electrical insulation 319A is positioned radially outward from internal insulator 320 (i.e., between internal insulator 320 and sheath 310). In other embodiments, the radial space is generally empty or free of any thermally conductive insulation.

In certain embodiments, the dielectric sheath of internal insulator 320 extends about resistive element 318 from first end portion 302 to second end portion 304. In turn, internal insulator 320 surrounds resistive element 318 across its full length. As illustrated, both cold pins 330A, 330B may be similarly surrounded by internal insulator 320. In some such embodiments, internal insulator 320 extends continuously or uninterrupted over each cold pin 330A, 320B and resistive element 318. Advantageously, internal insulator 320 may protect resistive element 318 and prevent arcing (e.g., during instances in which an unforeseen breakdown occurs within the thermally conductive electrical insulation 319).

Figure 11:
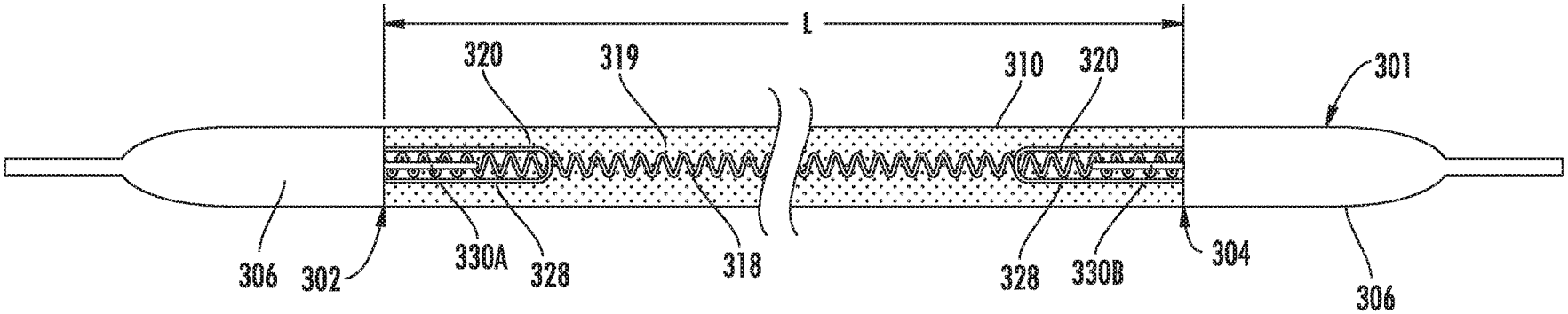
FIG. 11 provides a side view of a portion of a heating assembly of according to still further exemplary embodiments of the present disclosure.
Figure 12:
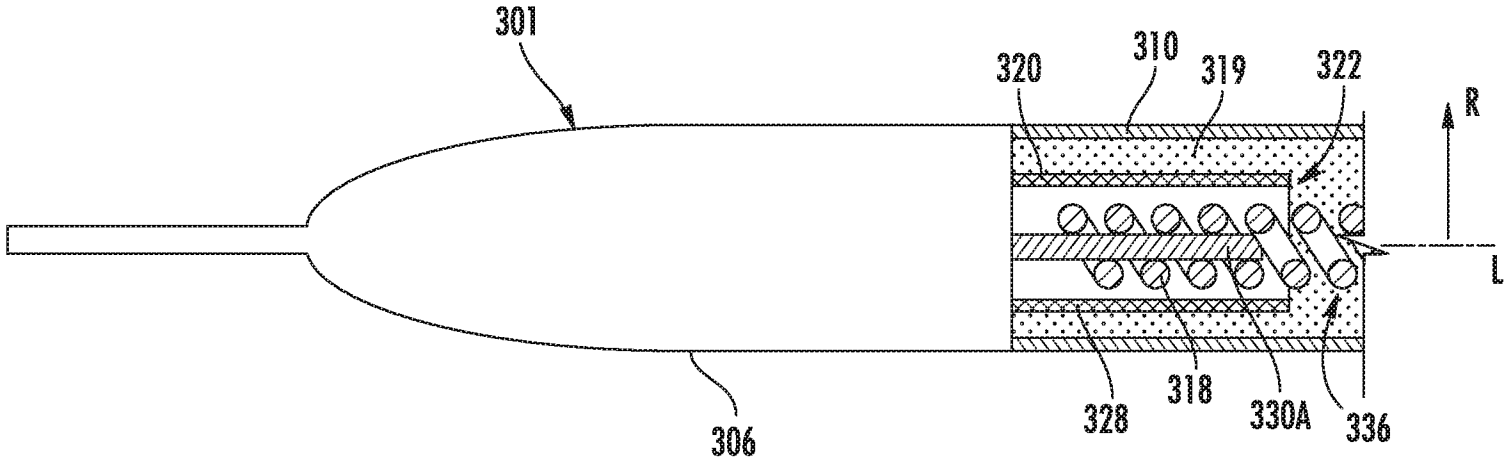
FIG. 12 provides a magnified side view of a portion of the exemplary heating assembly of FIG. 11.

Turning now to FIGS. 11 and 12, various views of portions of still further exemplary embodiments of electrical heater 301 are provided. In particular, FIG. 11 provides a side view (e.g., partial or interrupted side view) of a heating assembly 300 according to further exemplary embodiments. FIG. 11 provides a magnified view of a portion (e.g., at first end portion 302) of electrical heater 301. Except as otherwise indicated, it is understood that the exemplary embodiments of FIGS. 11 and 12 include one or more of the features of the above-described embodiments illustrated in FIGS. 1 through 10.

In some embodiments, internal insulator 320 is formed as or includes a dielectric sheath extending within enclosed volume 316. For instance, the dielectric sheath of internal insulator 320 may include a rigid tube formed from or including a suitable dielectric ceramic (e.g., oxides of aluminum, titanium, yttrium, etc.). In certain embodiments, the dielectric sheath of internal insulator 320 may be radially spaced from the resistive element 318 or cold pins 330A, 330B (e.g., across only a portion of resistive element 318). In other words, a predetermined radial space is defined between internal insulator 320 and resistive element 318 or cold pins 330A, 330B. The radial space may be constant along the length L of electrical heater 301 that is covered by internal insulator 320.

As shown, discrete sheath segments 328 (e.g., first and second segments) may be provided at the first end portion 302 and second end portion 304, respectively. Each sheath segment 328 may extend from a corresponding terminal 306 to a free end 322, which may be open (e.g., in the direction of the length L) to the rest of enclosed volume 316. Each sheath segment 328 extends continuously or uninterrupted over each cold pin 330A, 320B and an adjacent portion of resistive element 318. An uncovered section 336 of resistive element 318 may extend between the sheath segments 328. Thus, the sheath segments 328 may be spaced apart from each other along a portion of the length L between the first end portion 302 and the second end portion 304. Advantageously, internal insulator 320 may protect and prevent arcing at cold pins 330A, 330B and adjacent portions of resistive element 318 (e.g., during instances in which an unforeseen breakdown occurs within the thermally conductive electrical insulation 319).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber;

a sealed system comprising an evaporator, the evaporator disposed at the chilled chamber; and an electrical heater positioned adjacent the evaporator, the electrical heater comprising a resistive element, a sheath disposed about the resistive element from a first end portion to a second end portion, a thermally conductive electrical insulation radially positioned between the resistive element and the sheath, and an internal insulator radially positioned between the resistive element and the thermally conductive electrical insulation, wherein the electrical heater further comprises a pair of cold pins comprising a first end cold pin in electrical communication with the resistive element at the first end portion radially inward from the sheath, and a second end cold pin in electrical communication with the resistive element at the second end portion radially inward from the sheath, wherein the internal insulator extends axially from the first end portion over the first cold pin and at least a portion of the resistive element adjacent to the first cold pin, and wherein the internal insulator extends axially from the second end portion over the second cold pin and at least a portion of the resistive element adjacent to the second cold pin.

2. The refrigerator appliance of claim 1, wherein the internal insulator comprises a dielectric insulation coating applied to the resistive element.

3. The refrigerator appliance of claim 2, wherein the dielectric insulation coating extends across the resistive element from the first end portion to the second end portion.

4. The refrigerator appliance of claim 2, wherein the dielectric insulation coating comprises a discrete first segment applied to the resistive element at the first end portion and a discrete second segment applied to the resistive element at the second end portion, and wherein the first segment and the second segment are spaced apart along a length of the electrical heater between the first end portion and the second end portion.

5. The refrigerator appliance of claim 2, wherein each cold pin of the pair of cold pins is formed from a conductive metal have a lower electrical resistance than the resistive element, and wherein the dielectric insulation coating is radially positioned between the cold pins and the thermally conductive electrical insulation.

6. The refrigerator appliance of claim 1, wherein the internal insulator comprises a dielectric sheath radially spaced from the resistive element.

7. The refrigerator appliance of claim 6, wherein the dielectric sheath extends about the resistive element from the first end portion to the second end portion.

8. The refrigerator appliance of claim 6, wherein the dielectric sheath comprises a discrete first segment positioned about the resistive element at the first end portion and a discrete second segment positioned about the resistive element at the second end portion, and wherein the first segment and the second segment are spaced apart along a length of the electrical heater between the first end portion and the second end portion.

9. The refrigerator appliance of claim 6, wherein each cold pin of the pair of cold pins is formed from a conductive metal have a lower electrical resistance than the resistive element, and wherein the dielectric sheath is radially positioned between the cold pins and the thermally conductive electrical insulation.

10. The refrigerator appliance of claim 1, wherein the sealed system is charged with a flammable refrigerant.

11. An electrical heating assembly for a consumer appliance, the electrical heating assembly comprising:

a sheath defining an enclosed volume along a length between a first end portion and a second end portion;

a resistive element disposed within the enclosed volume to generate heat in response to an electrical current;

a thermally conductive electrical insulation radially positioned between the resistive element and the sheath;

an internal insulator radially positioned between the resistive element and the thermally conductive electrical insulation; and a pair of cold pins disposed within the enclosed volume, the pair of cold pins comprising a first end cold pin in electrical communication with the resistive element at the first end portion radially inward from the sheath, and a second end cold pin in electrical communication with the resistive element at the second end portion radially inward from the sheath, wherein the internal insulator extends axially from the first end portion over the first cold pin and at least a portion of the resistive element adjacent to the first cold pin, and wherein the internal insulator extends axially from the second end portion over the second cold pin and at least a portion of the resistive element adjacent to the second cold pin.

12. The electrical heating assembly of claim 11, wherein the internal insulator comprises a dielectric insulation coating applied to the resistive element.

13. The electrical heating assembly of claim 12, wherein the dielectric insulation coating extends across the resistive element from the first end portion to the second end portion.

14. The electrical heating assembly of claim 12, wherein the dielectric insulation coating comprises a discrete first segment applied to the resistive element at the first end portion and a discrete second segment applied to the resistive element at the second end portion, and wherein the first segment and the second segment are spaced apart along a length of the electrical heater between the first end portion and the second end portion.

15. The electrical heating assembly of claim 12, wherein each cold pin of the pair of cold pins is formed from a conductive metal have a lower electrical resistance than the resistive element, and wherein the dielectric insulation coating is radially positioned between the cold pins and the thermally conductive electrical insulation.

16. The electrical heating assembly of claim 11, wherein the internal insulator comprises a dielectric sheath radially spaced from the resistive element.

17. The electrical heating assembly of claim 16, wherein the dielectric sheath extends about the resistive element from the first end portion to the second end portion.

18. The electrical heating assembly of claim 16, wherein the dielectric sheath comprises a discrete first segment positioned about the resistive element at the first end portion and a discrete second segment positioned about the resistive element at the second end portion, and wherein the first segment and the second segment are spaced apart along a length of the electrical heater between the first end portion and the second end portion.

19. The electrical heating assembly of claim 16, wherein each cold pin of the pair of cold pins is formed from a conductive metal have a lower electrical resistance than the resistive element, and wherein the dielectric sheath is radially positioned between the cold pins and the thermally conductive electrical insulation.

20. The electrical heating assembly of claim 11, wherein the consumer appliance comprises a sealed system, including an evaporator, charged with a flammable refrigerant, wherein the electrical heating assembly is mounted adjacent the evaporator, and wherein a maximum surface temperature of the sheath is no greater than three hundred and sixty degrees Celsius during operation.

* * * * *